United States Patent [19]

Roosa

[11] 3,982,556

[45] Sept. 28, 1976

[54] TANK FLUSHING MEANS

[76] Inventor: Vernon D. Roosa, 184 Wood Pond Road, West Hartford, Conn. 06107

[22] Filed: Sept. 26, 1974

[21] Appl. No.: 509,648

[52] U.S. Cl. ..... 137/432; 4/41; 4/67 R

[51] Int. Cl.[2] ..... F16K 31/18

[58] Field of Search ..... 137/432, 437; 4/41, 4/67 R

[56] References Cited

UNITED STATES PATENTS

| | | | |
|---|---|---|---|
| 1,618,331 | 2/1927 | Gilchrist | 137/437 |
| 1,629,914 | 5/1927 | Haas | 137/437 |
| 2,444,958 | 7/1948 | Smith | 137/437 |
| 2,802,218 | 8/1957 | Wanger | 4/67 R X |
| 3,321,972 | 5/1967 | Goldtrap | 137/432 X |
| 3,773,063 | 11/1973 | Roosa | 137/432 X |

*Primary Examiner*—Martin P. Schwadron
*Assistant Examiner*—G. L. Walton

[57] ABSTRACT

An improved tank flushing system is described for use with a toilet bowl or other flushed system. An inlet valve for the tank includes a valve stem which is opened by a flush lever and which is closed by the force of the inflowing water under the control of a float. The outflow of the flushing water from the tank for the flushing operation is controlled by a flush valve comprising a flexible sealing member mounted on the tank bottom and coupled to a float. The flush valve is opened as the sealing member is lifted by the flush lever and remains opened under the control of the float until a predetermined volume of flush water has flowed from the tank.

8 Claims, 13 Drawing Figures

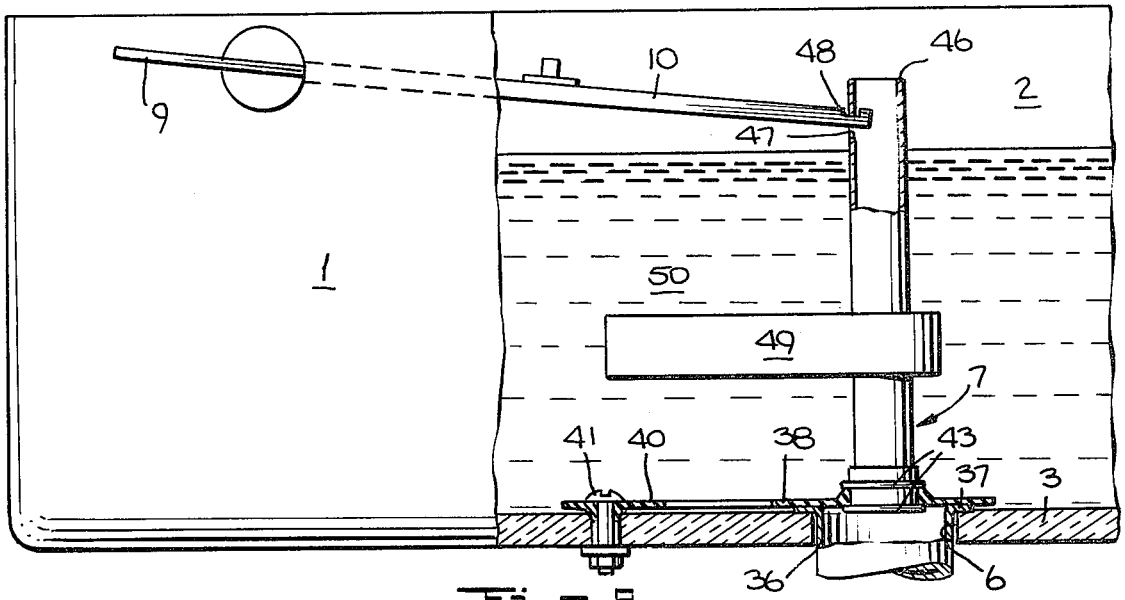
Fig. 9.
Fig. 10.
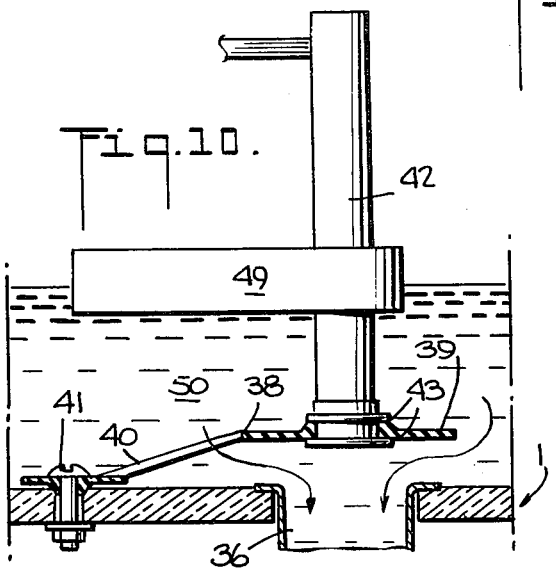
Fig. 11.
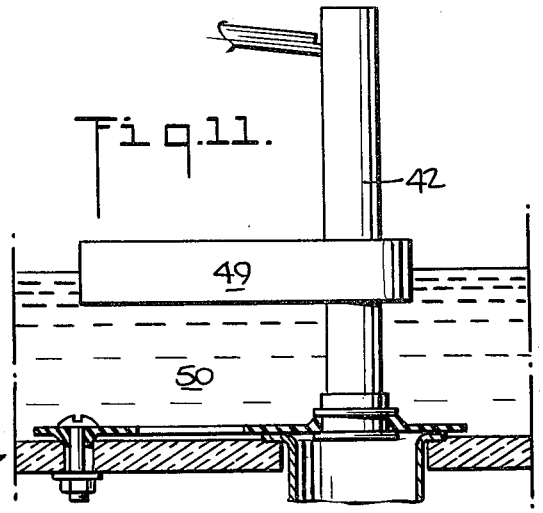
Fig. 12.
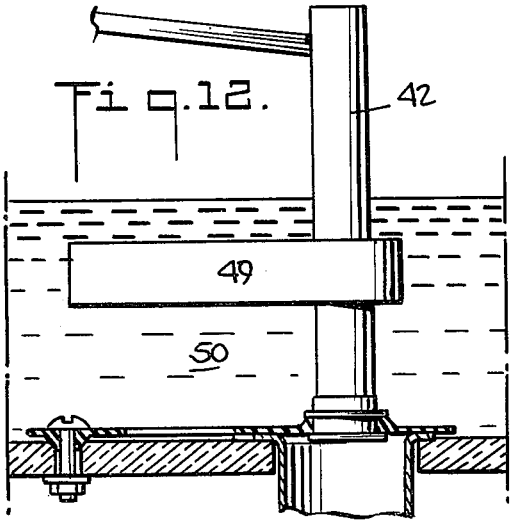
Fig. 8.
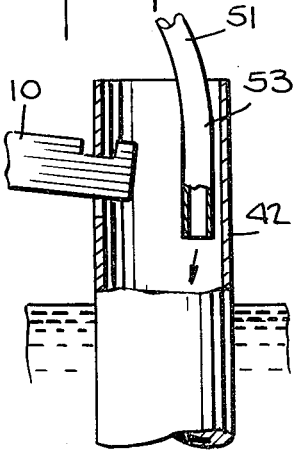
Fig. 13.
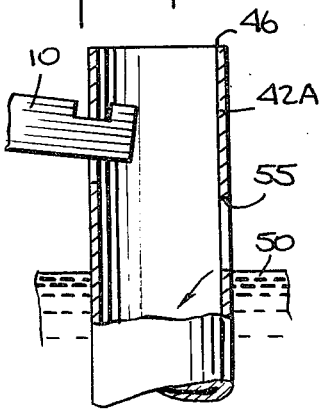

TANK FLUSHING MEANS

Background of the Invention

The present invention relates to an improved flush system for a flush tank used for toilet bowls and the like. It includes an improved inlet valve for controlling the supply of water which refills the tank and a cooperating flush valve operated by the flush lever to control the release of the flushing water from the tank to the flushed bowl.

There are numerous tank-type flushing systems in use which utilize a number of different devices for controlling the release of the flushing water from the filled tank and for automatically refilling the tank to a desired level after the flushing operation. In general, these systems include a flushing stopper or ball which is raised by the flushing lever to release the flushing water from the tank and a water inlet valve or cock which is operated by a float. A discharge of the flush water from the tank drops the float and opens the inlet valve. The rising level of the water during the tank refilling raises the float back to an inlet valve shut-off position when the flush tank has been refilled to the desired level.

The improved flushing system of the present invention provides a simplified and more effective flushing or water release valve operated by a flushing control lever and provides an improved water inlet valve of simplified form and having a reliable control action with a minimum number of relatively small moving parts.

Accordingly, an object of the present invention is to provide an improved flushing system for a flush tank.

Another object of the invention is to provide an improved flush or water release valve for a flushing tank.

Another object of the invention is to provide an improved and simplified water inlet valve for a tank.

Another object of the invention is to provide a simplified control system for a flush tank utilizing a minimum number of moving parts and formed of parts most of which may be advantageously formed of plastic.

Another object of the present invention is to provide a flush system with an improved water leveling means for the flushed receptacle.

Other and further objects of the invention will be obvious upon an understanding of the illustrative embodiment about to be described or will be indicated in the appended claims, and various advantages not referred to herein will occur to one skilled in the art upon employment of the invention in practice.

Brief Description of the Drawing

A preferred embodiment of the invention has been chosen for purposes of illustration and description and is shown in the accompanying drawing, forming a part of the specification, wherein:

FIG. 7 is an exploded perspective view of the water inlet valve.

FIG. 8 is a fragmentary side elevation view, partially in section, of the upper portion of the tank flush valve.

FIG. 9 is a front elevational view of the flush tank, partially in section, illustrating the tank flush valve in its closed position.

FIGS. 10, 11 and 12 are vertical sectional views corresponding to FIG. 9 illustrating the flush valve at successive positions during a flushing cycle.

FIG. 13 is an enlarged detailed view partially in section of another embodiment of the upper portion of the tank flush valve.

Description of the Preferred Embodiment

Figure 1:
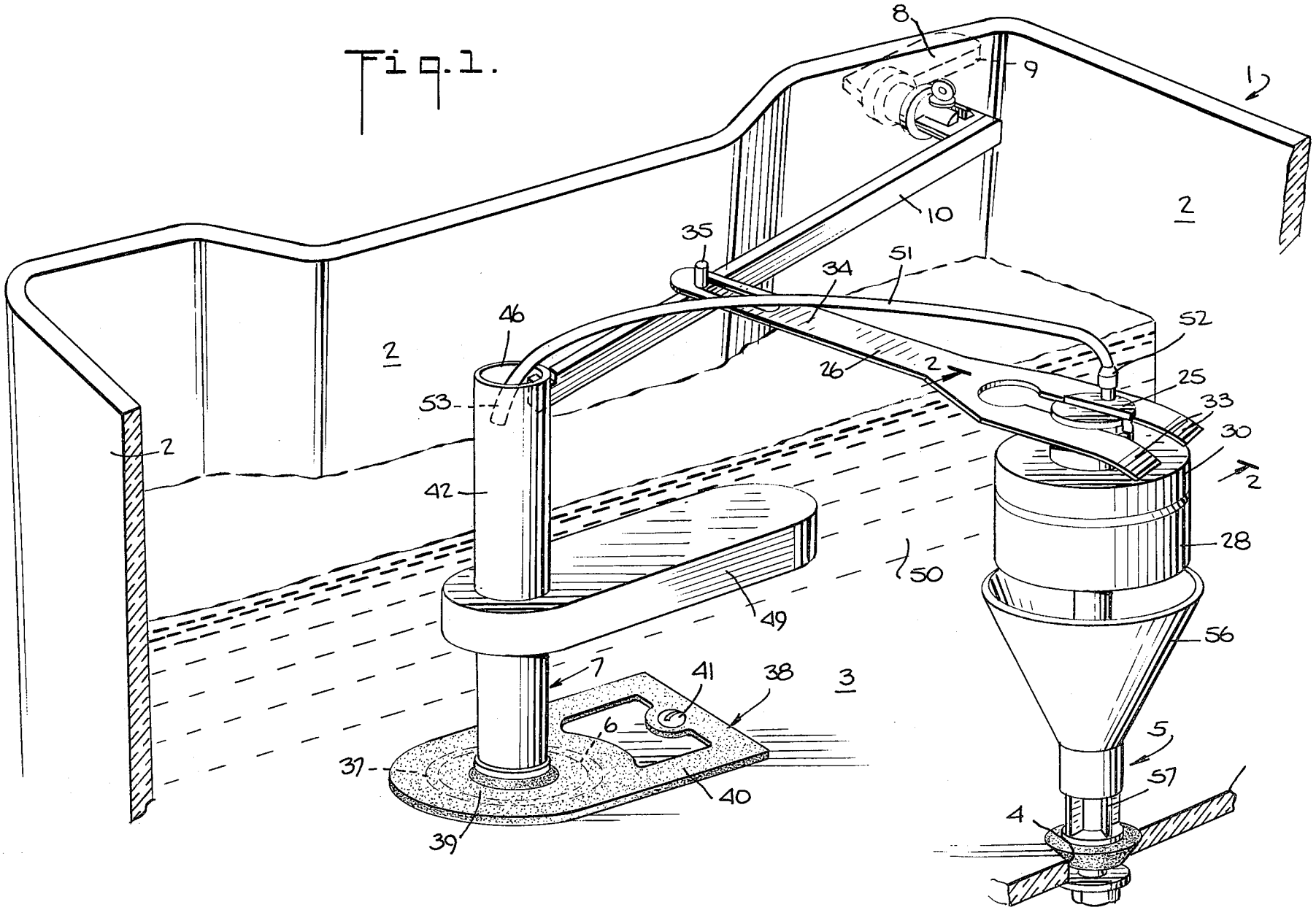
FIG. 1 is a perspective view of a preferred embodiment of the flushing system in accordance with the present invention.

Referring to the drawings which illustrate a preferred embodiment of the invention and more particularly to FIG. 1, a flush tank 1 is illustrated with sides 2 and a bottom 3 and having an open top for removably receiving a cover (not shown). The tank 1 has an opening 4 in its bottom 3 for a water inlet pipe 5 and a spaced outlet 6 to accommodate the flush valve 7 which couples the flush tank 1 to a toilet bowl or other flushed device. A third aperture 8 in the upper portion of the tank sides 2 is provided to mount a flush handle 9 and an innerconnected flush lever 10 on a suitable shaft 11.

The Water Inlet Pipe and Valve

Figure 2:
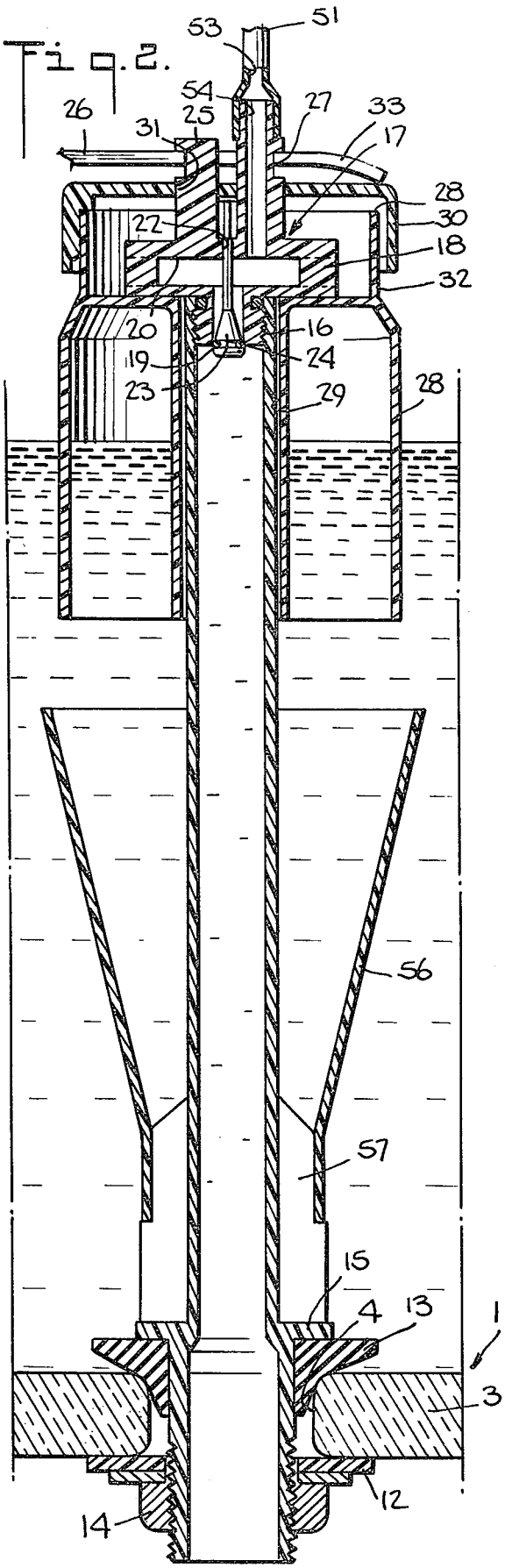
FIG. 2 is a vertical sectional view of the water inlet pipe and water inlet valve taken along line 2—2 on FIG. 1.
Figure 3:
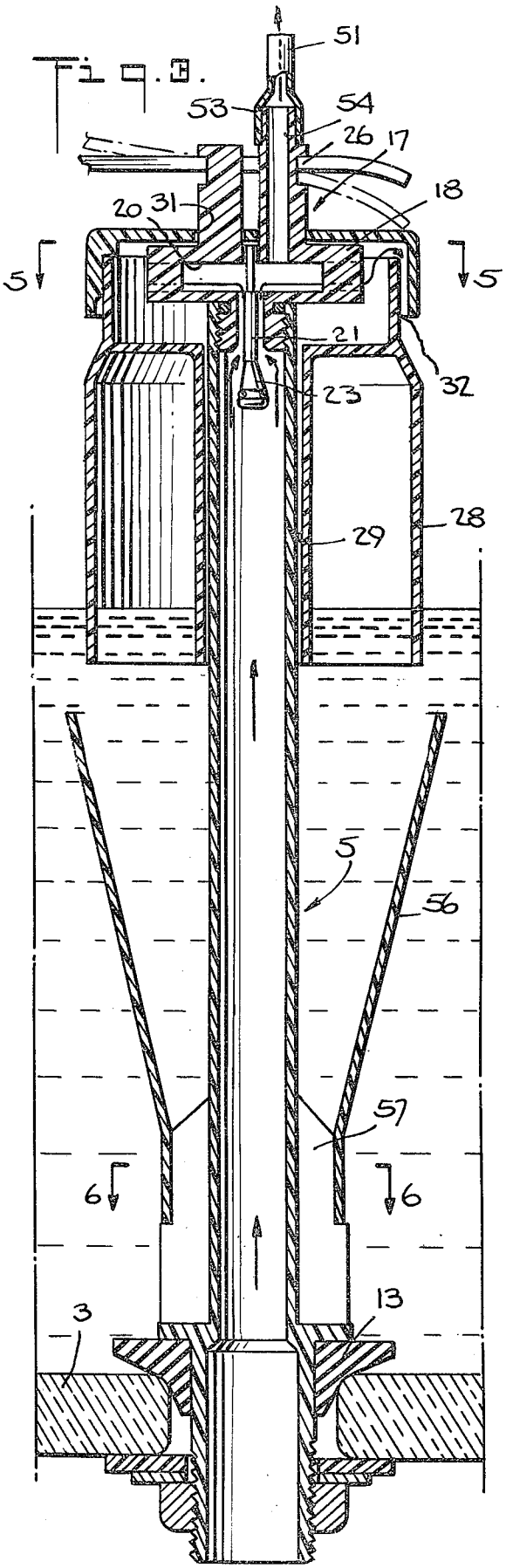
FIG. 3 is a vertical sectional view corresponding to FIG. 2 illustrating the water inlet valve in its open and tank filling position.
Figures 2, 4, 5, 6:
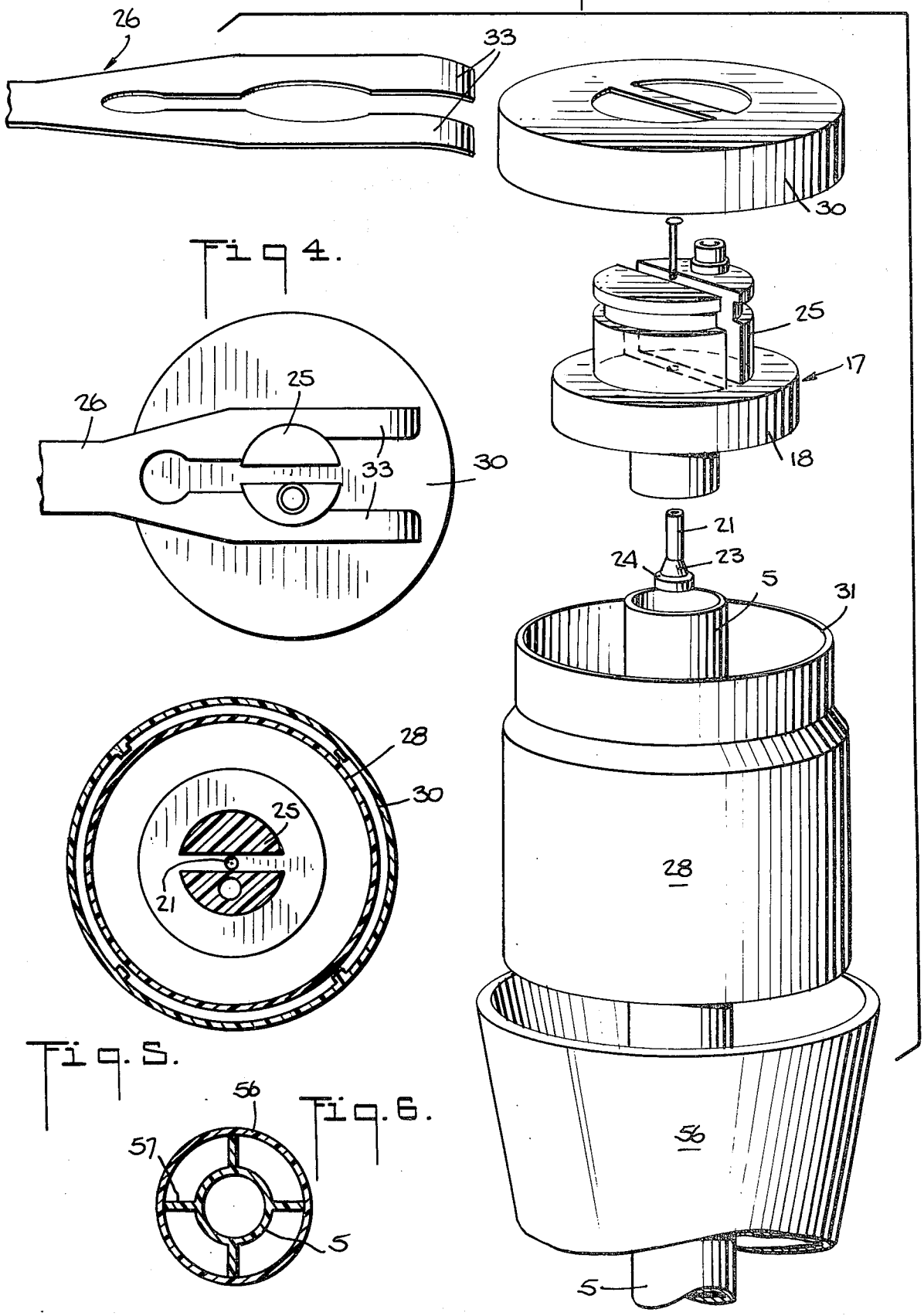
FIG. 4 is a fragmentary top plan view of the water inlet pipe.
FIG. 5 is a horizontal sectional view of the water inlet valve taken along line 5—5 on FIG. 3.
FIG. 6 is a horizontal sectional view of the water inlet pipe taken along line 6—6 on FIG. 3.

The improved water inlet and inlet valve will now be described with particular reference to FIGS. 2 through 7. The generally vertically mounted inlet pipe 5 is connected to the inlet opening 4 in the tank 1 by means of suitable mounting and sealing washers 12 and 13 and a nut 14. The inlet pipe 5 including its mounting flange 15 is preferably formed of plastic but may be formed of corrosion resisting metals. An interior thread 16 is provided at the top of the inlet pipe 5 for threadedly mounting the inlet valve 17. The inlet valve 17 comprises a body 18 including a valve seat 19 and a hollow central cavity 20 for passage of the incoming tank filling water. A valve stem 21 is slidably positioned in a stem receiving aperture 22 in the valve body 18. An enlarged lower sealing head 23 is provided on the stem 21 including a resilient valve seat engaging O-ring or other suitable seat engaging sealing member 24. The stem 21 is in its closed position when it is raised as seen in FIG. 2. The stem 21 is in its opened position when it is lowered, as will be described more fully below, to the position illustrated in FIG. 3. The upper portion of the valve body 18 includes an upwardly directed stud 25 which mounts a valve trip arm 26 in a groove 27 provided thereon so that the trip arm 26 is free to rock under the control of the flush lever 10. A hollow float 28 has a central aperture 29 which slidably engages the inlet pipe 5 permitting the float 28 to move vertically of the pipe with the tank water level during the flushing operation. The cover 30 of the float has a central aperture 31 which slidably engages the stud 25 so that the attached float 28 and float cover 30 move between raised and lowered positions, as illustrated in FIGS. 2 and 3, respectively, during the flushing action. A hollow silencer 56 is positioned below the float 28. It is mounted on suitable flanges 57 on the inlet pipe 5. In its preferred form it has a hollow inverted cone shape, as illustrated.

The operation of the inlet valve 17 during the flushing operation will now be described.

When the tank 1 is full prior to a flushing operation, the inlet valve 17 is in the position illustrated in FIG. 2. The valve stem 21 is in its closed or raised position. The float 28 is also in its fully raised position against the valve body 18 under the lifting force of the water in the filled tank 1. The valve trip arm 26 has its inner end 33 (FIG. 1) resting lightly on the cover 30 of float 28 and it is held in this position by the attachment of its outer end 34 to a connecting stud 35 on the flush lever 10 (FIG. 1). The valve 17 is held in its closed position by the force of the water in the inlet pipe 5 acting on the valve head 23. This force is sufficiently great to keep the valve 17 closed even though the float 28 may drop below the position illustrated due to a change in the tank water level. The weight of the float 28 on the valve stem 21 is insufficient to force the stem 21 downwardly against pressure of the water in the inlet pipe 5 without the added force from the trip arm 26. This prevents serious water waste even though the tank flush valve leaks.

When the tank 1 is flushed, the flush handle 9 swings the flush lever 10 upwardly together with the attached outer end 34 of the valve trip arm 26. This causes the inner end portion 33 of the valve trip arm 26 on the float cover 30 to move downwardly forcing the float 28 and the valve stem 21 downwardly to the open position of the valve 17, as illustrated in FIG. 3. At the same time the flush valve 7 in the flush tank 1 has been opened by the flush lever 10 permitting the water to flow out of the tank 1 and causing the float 28 to drop to the position illustrated in FIG. 3. The weight of the float 28 on the valve stem 21 then holds the stem 21 open during the tank refilling operation until the float 28 has again been lifted by the rising water in the tank 1 to its upper position, as illustrated in FIG. 2. As the weight of the float 28 is supported by the rising water, the force of the water flowing through the valve seat 19 raises the stem 21 closing the valve 17. By this time, the flush handle 9 will have been released so that the flush lever 10 will have returned to its lowered position as determined by the closed flush valve 7. This raises the inner end 33 of the valve trip arm 26 permitting the above described lifting of the float 28.

The Flush Valve

The preferred embodiment of the flush valve 7 will now be described with reference to the drawings and particularly to FIGS. 1 and 9 through 12. The function of the flush valve 7 is to release a predetermined volume of flush water from the tank 1 to the flushed bowl under the control of the flush handle 9. When the predetermined volume has been released, the flush valve 7 closes permitting the tank 1 to be refilled in the manner described above.

The flush valve 7 opens and closes the flush outlet 6 in the tank 1 which is connected by a suitable conduit 36 to the toilet bowl or other flushed device. The valve 17 includes a valve seat 37 which may be provided on the upper rim of the conduit 36 or otherwise. A valve sealing member 38 includes a sealing section 39 and a spaced coupling section 40 which is attached by a bolt 41 or other means to the tank 1 bottom (FIG. 1).

The preferred form of the sealing member 38 is a relatively flat member which is flexible or hinged adjacent the coupling section 40 to permit the lifting or opening action and which has a resilient or soft seat engaging area in its sealing section 39. All of the above requirements are present in a preferred embodiment of the sealing member cut or molded as a unitary member from rubber or plastic. Alternatively, the sealing member 38 may be formed in one or more pieces with the necessary characteristics included at the sealing and coupling portions.

The use of the coupling section 40 is seen to be advantageous as it provides a guide for the sealing section 39 as the sealing member 38 is lowered to its sealed position. This assures a correct reseal each time that the valve 7 closes to provide an extremely reliable resealing action for the flush valve 7. A hollow overflow tube 42 is tightly coupled to and sealed to the central portion of the sealing section 39 by means of suitable flanges 43 which provide a coupling groove 44 for the edges of an aperture 45 in the sealing member 38. The tube 42 provides a conduit between the upper portion of the tank 1 and the toilet bowl permitting water to overflow into the bowl whenever the level of the water within the tank 1 rises above its open top 46.

The flush valve 7 is opened by the flush handle 9 through the intermediation of the flush lever 10 which is coupled to the overflow tube 42 by the interlocking slot 47 in the pipe and slot 48 on the end of the lever 10 (FIG. 9). When the flush handle 9 is turned, the overflow tube 42 and the sealing member 38 are raised to the position illustrated in FIG. 10 thereby opening the outlet 6 and permitting the flush tank to drain into the toilet bowl. As this occurs, the water pressure is equalized on opposite sides of the valve sealing member 38 above the open outlet 6. A float 49 attached to the overflow tube 42 now holds the tube 42 upwardly as the float rides on the falling surface of the water 50 in the tank 1. The water 50 will continue to flow out of the tank 1 until the float 49 drops to a point where the sealing member 38 engages the valve seat 37 and closes the valve 7 (FIG. 11).

As the above described flushing action is occurring, water 50 is entering the tank 1 through the water inlet pipe 5 as the inlet valve 17 has been opened when the flush handle 9 was activated in the manner described above. With the flush valve 7 closed, water 50 rises in the tank 1 and submerges the float 49. The float 49 is proportioned so that it cannot lift the overflow tube 42 against the water pressure on the top of the valve sealing member 38 when the valve 7 is in its closed position, as illustrated in FIG. 12. The water level in the tank 1 will continue to rise until the inlet valve 17 is closed at a predetermined tank water level, as described above.

The float 49 is preferably adjustably positioned by friction or a set screw or otherwise on the tube 42 so that raising the float 49 on the tube 42 reduces the volume of the flush water released, and vice versa.

The overflow tube 42 is used to provide a toilet bowl leveling action to restore the bowl water level to the desired point after the flushing operation. This is done by discharging a portion of the water entering the flush tank 1 during the tank refilling downwardly through the overflow tube 42.

FIGS. 1 and 8 illustrate one embodiment of this system which comprises a refill tube 51 which communicates at 54 with the inlet valve cavity 20 at one end 52 and which has its opposite end 53 positioned within the overlow tube 42. When the inlet valve 17 is opened during the tank refill, a portion of the water being fed into the tank 1 will be diverted through the tube 51 into the toilet bowl to restore its level.

FIG. 13 illustrates an alternative embodiment of the toilet bowl leveling system. In this embodiment, the outlet 54 in the inlet valve 17 is eliminated together with the tube 51 and they are replaced by an aperture 55 near the top of the overflow tube 42A. A portion of the water 50 in the tank 1 flows through the aperture 55 and down the overflow tube 42 to restore the toilet bowl level. The amount of water 50 which thus flows through the aperture 55 is determined by the adjustment of the inlet valve 17 cut-off point. As already described, the inlet valve 17 closes when the float 28 has been lifted a predetermined distance in the tank 1 during the refilling operation. This cut-off point determines the uppermost level of the water in the tank 1 at a level somewhat above the level of the aperture 55 to provide the toilet bowl leveling water. As also already indicated, the improved inlet valve 17 described above, shuts off when the water in the tank 1 reaches a predetermined level and does not then reopen even though the tank water level falls. This permits the above described flow of a volume of bowl leveling water downwardly through the aperture 55 and the overflow tube 42.

It will be seen that the present invention provides a flushing device formed of a relative few parts of simplified form with an improved and more reliable flushing operation. An improved inlet valve in the device is adapted for having important components formed from molded plastic. The relatively inexpensive and easily manufactured inlet valve may be used to replace units in existing flush tank configurations.

The valve is opened with a flush lever and stays shut after the flush tank is filled even though water may leak from the flush tank thereby preventing a continuing water loss.

A cooperating and improved flush valve is provided which gives a more reliable closing action and which combines flush tank overflow and toilet bowl leveling features with means for adjustably determining the volume of water used in each flushing operation.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. An improved valve means for the top of an inlet pipe for a flushing tank comprising the combination of a valve body mounted on the pipe top, a liquid flow cavity in said body including a valve seat at the pipe top, a valve stem including a sealing portion for engaging said seat, means for movably mounting said stem in the valve body for motion in a downward direction to an open position against the force of liquid flowing through said pipe past said seat and for motion in an upward direction to a sealed position on said seat, a floatable stem moving member movably positioned on said valve body at the top of said inlet pipe for engaging and for moving said stem to its open position in said downward direction only, and a second member pivotally mounted on said valve body for engaging the top of said stem moving member for moving it downwardly against said stem.

2. The device as claimed in claim 1 in which said valve seat is positioned at the lower portion of said valve body cavity and in which said sealing portion of said valve stem is positioned below said seat when said stem is in its open position.

3. The device as claimed in claim 1 in which said valve body comprises a molded plastic member.

4. The device as claimed in claim 1 in which said valve body and said inlet pipe comprise plastic members.

5. The device as claimed in claim 1 which said second member is pivotally mounted on an integral upwardly extending portion of said valve body.

6. The device as claimed in claim 1 in which said floatable stem moving member is of a weight for holding said valve stem in its open position against the force of liquid flowing past said valve seat and for being of insufficient weight for moving the valve stem off of said seat in its when closed position.

7. The device as claimed in claim 1 in which said valve body includes a liquid outlet adapted for being coupled to a bowl leveling system.

8. The device as claimed in claim 1 which further comprises a hollow silencing member surrounding and spaced outwardly from the lower portion of said inlet pipe below said float.

* * * * *